US008586516B2

(12) United States Patent
Milner et al.

(10) Patent No.: US 8,586,516 B2
(45) Date of Patent: Nov. 19, 2013

(54) HIGH TBN / LOW PHOSPHORUS ECONOMIC STUO LUBRICANTS

(75) Inventors: Jeffrey L. Milner, Chesterfield, VA (US); Peter L. Leitner, Ashland, VA (US); John M. Pietras, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 1646 days.

(21) Appl. No.: 11/624,937

(22) Filed: Jan. 19, 2007

(65) Prior Publication Data

US 2008/0176777 A1 Jul. 24, 2008

(51) Int. Cl.

| | |
|---|---|
| ***C10M 141/10*** | (2006.01) |
| ***C10M 135/18*** | (2006.01) |
| ***C10M 137/10*** | (2006.01) |
| ***C10M 159/24*** | (2006.01) |

(52) U.S. Cl.
USPC ..... 508/372; 508/371; 508/391; 508/363

(58) Field of Classification Search
USPC ..... 508/364, 372, 371, 391, 363
See application file for complete search history.

(56) References Cited

U.S. PATENT DOCUMENTS

| | | | | |
|---|---|---|---|---|
| 4,259,194 | A | 3/1981 | deVries et al. | |
| 4,259,195 | A | 3/1981 | King et al. | |
| 4,261,843 | A | 4/1981 | King et al. | |
| 4,263,152 | A | 4/1981 | King et al. | |
| 4,265,773 | A | 5/1981 | deVries et al. | |
| 4,272,387 | A | 6/1981 | King et al. | |
| 4,283,295 | A | 8/1981 | deVries et al. | |
| 4,285,822 | A | 8/1981 | deVries et al. | |
| 4,702,850 | A | 10/1987 | Gutierrez et al. | |
| 4,943,672 | A | 7/1990 | Hamner et al. | |
| 5,672,572 | A | 9/1997 | Arai et al. | |
| 5,882,505 | A | 3/1999 | Wittenbrink et al. | |
| 6,013,171 | A | 1/2000 | Cook et al. | |
| 6,074,993 | A | 6/2000 | Waddoups et al. | |
| 6,080,301 | A | 6/2000 | Berlowitz et al. | |
| 6,096,940 | A | 8/2000 | Wittenbrink et al. | |
| 6,103,099 | A | 8/2000 | Wittenbrink et al. | |
| 6,165,949 | A | 12/2000 | Berlowitz et al. | |
| 6,180,575 | B1 | 1/2001 | Nipe | |
| 6,300,291 | B1 | 10/2001 | Hartley et al. | |
| 6,426,323 | B1 * | 7/2002 | Sato et al. | 508/371 |
| 6,723,685 | B2 | 4/2004 | Hartley et al. | |
| 6,872,738 | B1 | 3/2005 | Auguet et al. | |
| 7,906,469 | B2 | 3/2011 | Arrowsmith et al. | |
| 2002/0119895 | A1 * | 8/2002 | Cook et al. | 508/186 |
| 2003/0148895 | A1 * | 8/2003 | Robson et al. | 508/155 |
| 2004/0192566 | A1 * | 9/2004 | Vinci | 508/460 |
| 2005/0059562 | A1 | 3/2005 | Garmier | |
| 2006/0272401 | A1 | 12/2006 | Devlin et al. | |

FOREIGN PATENT DOCUMENTS

| | | |
|---|---|---|
| DE | 69411563 | 5/1993 |
| EP | 0700425 | 3/1996 |
| EP | 1661970 | 5/2006 |
| GB | 2423524 | 8/2006 |
| WO | 94/06897 A1 | 3/1994 |
| WO | 9637585 | 11/1996 |

OTHER PUBLICATIONS

Klamann, Dieter: Schmierstoffe and verwandte Produkte. Weinheim, Verlag Chemie, 1982, p. 97-98. ISBN 3-527-25966-X.

Rounds F: "Effects of Organic Molybdenum Compounds on the Friction and Wear Observed With ZDP-Containing Lubricant Blends" Tribology Transactions, The Society, Park Ridge, IL, US, vol. 33, (Oct. 16, 1989), pp. 345-354, XP001018631 ISSN: 1040-2004 *table 1*.

* cited by examiner

*Primary Examiner* — Jim Goloboy
(74) *Attorney, Agent, or Firm* — Luedeka Neely Group, P.C.

(57) ABSTRACT

There is disclosed a Super Tractor Oil Universal lubricating composition comprising an oil of lubricating viscosity formulated with an additive package comprising at least one metal detergent, at least one phosphorus-based wear preventative, and at least one molybdenum compound. Methods for improving the braking performance of a tractor and the anti-wear protection of a tractor engine are also disclosed.

18 Claims, No Drawings

HIGH TBN / LOW PHOSPHORUS ECONOMIC STUO LUBRICANTS

FIELD

The present disclosure relates to lubricating compositions, additive packages, and methods for super tractor oil universal.

BACKGROUND

In North America, tractor lubricants are often referred to as Universal Tractor Transmission Oils ("UTTO") or Tractor Hydraulic Fluids ("THF"). These lubricants provide performance required for hydraulics, transmission, gears, power take-off ("PTO"), and wet-brakes. In international and emerging markets, Super Tractor Universal Oil ("STUO" or "STOU") lubricants are more widely used. STUO lubricants provide satisfactory lubrication of diesel and gasoline engines, in addition to providing the performance required for hydraulic, transmission, gear, PTO, and wet brake systems.

To meet these varied requirements, tractor lubricants must balance a large number of performance properties. UTTO and STUO tractor lubricants must provide anti-wear, provide load-carrying protection, and control frictional characteristics for equipment durability. In addition, the STUO tractor lubricants must maintain basic engine performance, without compromising the requirements of THFs for wet brake, PTO, transmission, gear, and hydraulics performance. Many of the additives used in tractor lubricant formulation are multifunctional and there is often a conflict generated between properties. To ensure that the tractor lubricant operates over a wide temperature range, it is necessary for the oil to be multi-grade. This requires the use of carefully chosen base oils combined with viscosity index improvers and pour point depressants to achieve the low and high temperature viscosity limits.

These conflicts inevitably mean that additives must be carefully selected and balanced. There thus, exists a need for a low phosphorous-based STUO, which maintains good anti-wear and extreme pressure protection required for gear, transmission, and hydraulic performance. In addition, having a lower treat rate additive package may reduce additive shipping costs, improve plant through-put, and provide economic benefits to lubricant blenders in terms of lower net additive treat costs.

SUMMARY

In accordance with the disclosure, a super tractor oil universal (STUO) lubricating composition may comprise an oil of lubricating viscosity having a viscosity index of at least 95. The lubricating composition may also comprise additive components comprising at least one metal detergent, at least one phosphorus-based wear preventative, and at least one oil soluble molybdenum compound. The lubricating composition may be characterized in that a ratio between a content (ppm) of metal based on the total weight of the lubricating composition and a total base number of the lubricating composition (mg KOH/g) ranges from about 210 to about 450 (ppm/mg KOH/g). The lubricating composition may comprise a ratio between the content (ppm) of the metal based on the total weight of the lubricating composition and a content (ppm) of phosphorus based on the total weight of the lubricating composition that range from about 5.0 to about 20.0 (ppm/ppm). The lubricating composition may comprise a ratio between the content (ppm) of phosphorus based on the total weight of the lubricating composition and a content (ppm) of molybdenum based on the total weight of the lubricating composition that ranges from about 0.5 to about 80.0 (ppm/ppm).

Further, a super tractor oil universal additive package may comprise a metal detergent, a phosphorus-based wear preventative, and an oil soluble molybdenum compound. The additive package may be characterized in that a ratio between the content (ppm) of the metal based on the total weight of the additive package and a content (ppm) of phosphorus based on the total weight of the additive package ranges from about 5.0 to about 20.0 (ppm/ppm). The additive package may comprise a ratio between the content (ppm) of phosphorus based on the total weight of the additive package and a content (ppm) of molybdenum based on the total weight of the additive package ranging from about 0.5 to about 80.0 (ppm/ppm).

Further, a method for improving the braking performance of a tractor may comprise (1) adding to a tractor the lubricating oil composition; and (2) operating the wet brake of the tractor.

Further, a method for improving the anti-wear protection of a tractor may comprise (1) adding to a tractor engine the lubricating oil composition; and (2) operating the engine of the tractor.

Additional objects and advantages of the disclosure will be set forth in part in the description which follows, and/or can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EMBODIMENTS

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents such as pyridyl, furyl, thienyl, and imidazolyl. In general, no more than two, for example, no more than one, non-hydrocarbon substituent will be present for every ten carbon atoms in the hydrocarbyl group; typically, there will be no non-hydrocarbon substituents in the hydrocarbyl group.

As used herein, the term "percent by weight", unless expressly stated otherwise, means the percentage the recited component represents to the weight of the entire composition.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Key Lubricant Requirements Necessary for Performance Characteristics

The engine is the basic power unit of a tractor. A turbocharged diesel engine is most often used in modern generation tractors; however, aspirated diesel and gasoline engines are also used. STUO lubricants must provide the standard properties of a crankcase lubricant such as detergency/dispersancy, oxidation stability, anti-wear/EP load carrying ability, and corrosion/rust protection. API Commercial Diesel ("API CX") quality lubricants provide adequate protection for engines used in STUO applications. API CD (as used herein "CD") quality lubricants provide moderately supercharged diesel performance and meet MIL-L-2104C and Caterpillar Series 3 lubricant specifications.

The transmission transfers power from the engine to the final drive, therefore the lubricant must be resistant to oxidation, provide anti-wear protection, and provide controlled friction. The final drive gears transfer power to the wheels which operate under low speed and high torque conditions. API GL-4 (as used herein "GL-4) lubricants meet the performance requirements for transmissions.

Gear wear protection is a critical performance parameter and is the major lubricant-related contributor to durability of the transmission, differential, and final drive. The performance level of current tractor lubricants is targeted at GL-4 under low speed, high torque conditions.

Tractor wet-brakes aid in maneuvering as well as stopping, which requires a lubricant to have balanced friction characteristics to avoid the stick-slip action while not impairing the brake's capacity to stop quickly. Stick-slip generates brake noise during certain braking conditions, which is unacceptable to the operators (typically farmers). The PTO transfers mechanical power to auxiliary equipment, and the clutch must be capable of stalling the tractor engine in the event the auxiliary equipment gets jammed. If the lubricant is too slippery, the clutch plates may glaze and premature PTO failure can result. These opposing frictional properties of the lubricant for wet brakes and PTO must be achieved and maintained throughout the oil drain period.

The hydraulic units provide power to auxiliary equipment and sometimes hydrostatic transmissions. For satisfactory service, tractor lubricants must provide a range of properties common to industrial hydraulic fluids which include low temperature fluidity, shear stability, oxidation stability, anti-wear/load carrying protection, corrosion/rust inhibition, seal compatibility, water tolerance, filterability, antifoam, and aeration properties.

Another important area of lubricant performance necessary for satisfactory field service is compatibility with contaminants. Three main contaminants exist. The first is water, which enters the tractor mechanical systems by virtue of the exposed environment in which the tractor operates. Water can yield corrosion problems and can cause hydrolytic decomposition of additives in the lubricant leading to degradation of performance and formation of emulsions/insolubles which produce filterability problems. The second contaminant is dirt which is also a function of the operating environment and can lead directly to anti-wear and filterability performance losses. The combination of water and dirt can cause magnified filterability problems, such as, early filter blockage. Early filter blockage can lead to complete loss of contaminant control, severely derating wear performance. The importance of these problems in relation to protection of critical hydraulic control systems is well documented. The third contaminant is other lubricants. Other lubricants may enter the tractor either by mis-lubrication or through the hydraulic outlet that connects to auxiliary equipment containing another lubricant. This leads to incompatibility and general performance loss.

Lubricant Additives Used to Formulate Tractor Oils

The three major additive types that may be contained in a tractor transmission lubricant are friction modifiers, anti-wear/extreme pressure additives, and dispersant/detergent additives. Friction modifiers may be included, for example, to control wet brake noise and PTO performance. Anti-wear/EP additives are important, for example, in the final drive. Dispersant/detergent additives may be included, for example, to provide good engine performance in STUOs and proper frictional characteristics and water sensitivity in UTTOs. Suitable friction modifiers include a wide range of organic chemistry. Examples include fatty amine or amide derivatives and sulfurized esters. Anti-wear/EP additives may include zinc dithiophosphates combined with an organic phosphorous or sulfur based additive. The dispersants and detergents may include, for example, ashless succinimides, overbased or low based sulfonates, and phenate derivatives. In addition, the lubricant may also contain antioxidants—to control oxidation stability, anti-corrosion additives, and defoamants (also referred to herein as antifoamants and antifoam agents).

Many of the additives used in tractor lubricant formulation are multifunctional and there is often a conflict generated between properties. Detergents used for engine performance can be detrimental for wet brake noise. These conflicts inevitably mean that the oil formulator must select and balance the additives.

Anti-wear additives provide good wear protection in engines but can be corrosive to copper components in hydraulic pumps. Historically, zinc dialkyl dithiophosphates (ZDDP) have been the main antiwear/EP components used in engine, transmission, and some gear (GL-4) applications; however, the high level of sulfur, phosphorous, and zinc have been blamed for poisoning exhaust catalyst. As the use of low phosphorous-based engine oils (EOs) continues to increase, there exist a need to develop low phosphorous STUO packages, which maintains good antiwear and extreme pressure protection required for gear, transmission, and hydraulic performance of low phosphorous STUO lubricants. In addition, lower treat rate additive packages reduce additive shipping costs, improve plant through-put, and provide economic benefits to lubricant blenders in terms of lower net additive treat costs.

In an aspect, there is provided a STUO comprising an oil of lubricating viscosity formulated with additive components formulated with additive components comprising at least one metal detergent, at least one phosphorus-based wear preventative, and at least one oil soluble molybdenum compound.

Oil of Lubricating Viscosity

Oils of lubricating viscosity (i.e., base oils) suitable for use in formulating embodiments herein may be selected from any of the synthetic oils, mineral oils, or mixtures thereof. In an aspect, the composition can comprise a combination of a vegetable oil and a synthetic oil as disclosed in U.S. Patent Application No. 2005/0059562, published Mar. 17, 2005.

Mineral oils include animal oils and vegetable oils (e.g., castor oil, lard oil) as well as other mineral lubricating oils such as liquid petroleum oils and solvent treated or acid-treated mineral lubricating oils of the paraffinic, naphthenic or mixed paraffinic-naphthenic types. Oils derived from coal or shale are also suitable. Further, oils derived from a gas-to-liquid process are suitable.

Suitable base oils for STUOs may be classified according to SAE J300 viscosity grade for engine oils. Suitable oils may have a viscosity range of about SAE 0W to about 60W for single grade. Further, suitable cross grades (or multi-grades) may range from about 0W-30, 10W-30, 15W-40, and the like. Further, suitable base oils for STUOs may be classified according to J306 automotive gear lubricant viscosity classification. Suitable oils may have a viscosity range of about 70W to 250W for single grade. Suitable cross grades (or multi-grades) may range from about 70W90, 75W140, 80W90, 85W140, and the like. Other suitable grades include ISO viscosity grades typically used for hydraulic oils such as ISO 22 to ISO 600 grade oils.

The base oil can be present in a major amount wherein "major amount" is understood to mean greater than or equal to 50 wt. %, for example from about 80 to about 98 percent by weight of the lubricating composition.

Base oils suitable for use in the present embodiments may have a viscosity index of greater than about 95.

Non-limiting examples of synthetic oils include hydrocarbon oils such as polymerized and interpolymerized olefins (e.g., polybutylenes, polypropylenes, propylene isobutylene copolymers, and the like); polyalphaolefins such as poly(1-hexenes), poly-(1-octenes), poly(1-decenes), etc. and mixtures thereof; alkylbenzenes (e.g., dodecylbenzenes, tetradecylbenzenes, di-nonylbenzenes, di-(2-ethylhexyl)benzenes, and the like); polyphenyls (e.g., biphenyls, terphenyl, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, and the like, constitute another class of known synthetic oils that can be used. Such oils are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, and the like) or mono- and polycarboxylic esters thereof, for example, the acetic acid esters, mixed $C_{3-8}$ fatty acid esters, or the $C_{13}$ Oxo acid diester of tetraethylene glycol.

Another class of synthetic oils that can be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, and the like) with a variety of alcohols (e.g., butyl alcohol, hexyl alcohol, dodecyl alcohol, 2-ethylhexyl alcohol, ethylene glycol, diethylene glycol monoether, propylene glycol, and the like) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_{5-12}$ monocarboxylic acids and polyols and polyol ethers such as neopentyl glycol, trimethylol propane, pentaerythritol, dipentaerythritol, tripentaerythritol, and the like.

Hence, the base oil used which can be used to make the compositions as described herein can be selected from any of the base oils in Groups I-V as specified in the American Petroleum Institute (API) Base Oil Interchangeability Guidelines. Such base oil groups are as follows:

Group I base oils contain less than 90% saturates and/or greater than 0.03% sulfur and have a viscosity index (VI) greater than or equal to 80 and less than 120; Group II base oils contain greater than or equal to 90% saturates and less than or equal to 0.03% sulfur and have a viscosity index greater than or equal to 80 and less than 120; Group III base oils contain greater than or equal to 90% saturates and less than or equal to 0.03% sulfur and have a viscosity index greater than or equal to 120; Group IV base oils comprise polyalphaolefins (PAO); and Group V base oils comprise all other basestocks not included in Group I, II, III or IV.

The test methods used in defining the above groups are ASTM D2007 for saturates; ASTM D2270 for viscosity index; and one of ASTM D2622, 4294, 4927 and 3120 for sulfur.

Group IV basestocks, i.e. polyalphaolefins (PAO) include hydrogenated oligomers of an alpha-olefin, the most important methods of oligomerisation being free radical processes, Ziegler catalysis, and cationic, Friedel-Crafts catalysis.

The polyalphaolefins typically have viscosities in the range of 2 to 100 cSt at 100° C., for example 4 to 8 cSt at 100° C. They can, for example, be oligomers of branched or straight chain alpha-olefins having from about 2 to about 30 carbon atoms, non-limiting examples include polypropenes, polyisobutenes, poly-1-butenes, poly-1-hexenes, poly-1-octenes and poly-1-decene. Included are homopolymers, interpolymers and mixtures.

Regarding the balance of the basestock referred to above, a "Group I basestock" also includes a Group I basestock with which basestock(s) from one or more other groups can be admixed, provided that the resulting admixture has characteristics falling within those specified above for Group I basestocks.

Basestocks suitable for use herein can be made using a variety of different processes including but not limited to distillation, solvent refining, hydrogen processing, oligomerisation, esterification, and re-refining.

The base oil can be an oil derived from Fischer-Tropsch synthesized hydrocarbons. Fischer-Tropsch synthesized hydrocarbons can be made from synthesis gas containing $H_2$ and CO using a Fischer-Tropsch catalyst. Such hydrocarbons typically require further processing in order to be useful as the base oil. For example, the hydrocarbons can be hydroisomerized using processes disclosed in U.S. Pat. No. 6,103,099 or U.S. Pat. No. 6,180,575; hydrocracked and hydroisomerized using processes disclosed in U.S. Pat. No. 4,943,672 or U.S. Pat. No. 6,096,940; dewaxed using processes disclosed in U.S. Pat. No. 5,882,505; or hydroisomerized and dewaxed using processes disclosed in U.S. Pat. No. 6,013,171; 6,080,301; or U.S. Pat. No. 6,165,949.

Unrefined, refined, and rerefined oils, either mineral or synthetic (as well as mixtures of two or more of any of these) of the type disclosed hereinabove can be used in the base oils. Unrefined oils are those obtained directly from a mineral or synthetic source without further purification treatment. For example, a shale oil obtained directly from retorting operations, a petroleum oil obtained directly from primary distillation, or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, and the like. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

Metal Detergent

Embodiments of the present disclosure may comprise at least one metal detergent. Detergents generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from about 0 to less than about 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of about 150 or greater, such as from about 150 to about 450 or more.

Detergents that may be used the present embodiments include oil-soluble neutral and overbased sulfonates, phenates, sulfurized phenates, and salicylates of a metal, particularly the alkali or alkaline earth metals, e.g., sodium, potassium, lithium, calcium, and magnesium. The most commonly used metals are calcium and magnesium, which may both be present. Mixtures of calcium and/or magnesium with sodium are also useful. Particularly convenient metal detergents are neutral and overbased calcium or magnesium sulfonates having a TBN of from 20 to 450 TBN, neutral and overbased calcium or magnesium phenates and sulfurized phenates having a TBN of from 50 to 450, and neutral or overbased calcium or magnesium salicylates having a TBN of from 130 to 350. Mixtures of such salts may also be used. When used, the presence of at least one overbased detergent is desirable. As an example, suitable metal detergents may include at least one of a calcium phenate, a calcium salicylate, a calcium sulfonate, and mixtures thereof. As another example, at least two metal detergents may be used. For example, a metal sulfonate and a metal phenate may be used. As a further example, an overbased metal sulfonate and an overbased metal phenate may be used.

Phosphorus-Based Wear Preventative

The phosphorus-based wear preventative may comprise a metal dihydrocarbyl dithiophosphate compound, such as but not limited to a zinc dihydrocarbyl dithiophosphate compound. Suitable metal dihydrocarbyl dithiophosphates may comprise dihydrocarbyl dithiophosphate metal salts wherein the metal may be an alkali or alkaline earth metal, or aluminum, lead, tin, molybdenum, manganese, nickel, copper, or zinc. The zinc salts are most commonly used in lubricating oil.

Dihydrocarbyl dithiophosphate metal salts may be prepared in accordance with known techniques by first forming a dihydrocarbyl dithiophosphoric acid (DDPA), usually by reaction of one or more alcohol or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The zinc dihydrocarbyl dithiophosphates (ZDDP) are oil soluble salts of dihydrocarbyl dithiophosphoric acids and may be represented by the following formula:

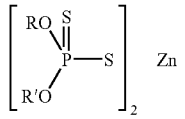

wherein R and R' may be the same or different hydrocarbyl radicals containing from 1 to 18, for example 2 to 12, carbon atoms and including radicals such as alkyl, alkenyl, aryl, arylalkyl, alkaryl, and cycloaliphatic radicals. R and R' groups may be alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e., R and R') in the dithiophosphoric acid will generally be about 5 or greater. The zinc dihydrocarbyl dithiophosphate can therefore comprise zinc dialkyl dithiophosphates.

Other suitable components that may be utilized as the phosphorus-based wear preventative include any suitable organophosphorus compound, such as but not limited to, phosphates, thiophosphates, phosphites, and salts thereof and phosphonates. Suitable examples are tricresyl phosphate (TCP), di-alkyl phosphite (e.g., dibutyl hydrogen phosphite), and amyl acid phosphate.

The phosphorus-based wear preventative may be present in an amount sufficient to provide about 200 to about 800 ppm phosphorus in a fully formulated STUO fluid. As a further example, the phosphorus-based wear preventative may be present in an amount sufficient to provide about 200 to about 400 ppm phosphorus in a fully formulated STUO fluid. As an even further example, the phosphorus-based wear preventative may be present in an amount to provide about 295 ppm phosphorus.

Molybdenum Compound

The molybdenum compound may comprise an organo-molybdenum compound. For example, the molybdenum compound may comprise, but is not limited to, one or more of a molybdenum dialkyldithiocarbamate, a molybdenum dialkyldithiophosphate, a molybdenum dialkyldithiophosphinate, a molybdenum xanthate, a molybdenum thioxanthate, and mixtures thereof.

The molybdenum compound may be mono-, di-, tri- or tetra-nuclear. The molybdenum compound may be an organo-molybdenum compound. The molybdenum compound may be selected from the group consisting of molybdenum dithiocarbamates (MoDTC), molybdenum dithiophosphates, molybdenum dithiophosphinates, molybdenum xanthates, molybdenum thioxanthates, molybdenum sulfides, a trinuclear organo-molybdenum compound and mixtures thereof.

Additionally, the molybdenum compound may be an acidic molybdenum compound. Such compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Among the molybdenum compounds useful in the present compositions are organo-molybdenum compounds of the formulae: $Mo(ROCS_2)_4$ and $Mo(RSCS_2)_4$, wherein R is an organo group selected from the group consisting of alkyl, aryl, aralkyl, and alkoxyalkyl, generally of from 1 to 30 carbon atoms, and preferably 2 to 12 carbon atoms and most preferably alkyl of 2 to 12 carbon atoms. An example is the dialkyldithiocarbamates of molybdenum.

One class of useful organo-molybdenum compounds are trinuclear molybdenum compounds, especially those of the formula $MO_3S_kL_nQ_z$ and mixtures thereof, wherein L is independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference.

The molybdenum compound may be present in a fully formulated STUO in an amount to provide about 10 ppm to 200 ppm molybdenum. As a further example, the molybdenum compound may be present in an amount to provide about 70 ppm molybdenum.

Friction Modifier

Some embodiments of the present disclosure may include one or more friction modifiers. Suitable friction modifiers may comprise organic ashless friction modifiers, for example, an oleyl amide.

Further examples of suitable friction modifiers include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, and the like.

Suitable friction modifiers may contain hydrocarbyl groups that are selected from straight chain, branched chain, or aromatic hydrocarbyl groups or admixtures thereof, and may be saturated or unsaturated. They hydrocarbyl groups may be composed of carbon and hydrogen or hetero atoms such as sulfur or oxygen. The hydrocarbyl groups may range from about 12 to about 25 carbon atoms and may be saturated or unsaturated.

Another example of suitable friction modifiers includes amides of polyamines. Such compounds can have hydrocarbyl groups that are linear, either saturated or unsaturated or a mixture thereof and may contain from about 12 to about 25 carbon atoms.

Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference.

Suitable friction modifiers may comprise an organic, ashless (metal-free), nitrogen-free organic friction modifier. Such friction modifiers may include esters formed by reacting carboxylic acids and anhydrides with alkanols. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Another example of an organic ashless nitrogen-free friction modifier is glycerol monooleate (GMO). Other suitable friction modifiers are described in U.S. Pat. No. 6,723,685, herein incorporated by reference.

Additional Components

In addition to the other components described herein an additive package may comprise, for example, one or more of an ashless dispersant, a rust inhibitor, an antifoam agent, an antioxidant, and a diluent oil. Further optional components may include viscosity modifiers, copper and lead bearing corrosion inhibitors, demulsifying agents, and pour point depressants.

Embodiments may comprise a finished fluid, i.e., a STUO lubricating oil composition comprising an oil of lubricating viscosity, or an additive package. A super tractor oil universal lubricating composition according to embodiments described herein may comprise an oil of lubricating viscosity formulated with an additive package. The additive package may comprise the following additive components: at least one metal detergent; ii) at least one phosphorus-based wear preventative; and iii) at least one oil soluble molybdenum compound.

The components may be combined such that a ratio between a content (ppm) of metal derived from said metal detergent and based on the total weight of the lubricating oil composition and a total base number of the lubricating composition (mg KOH/g) ranges from about 210 to about 450 (ppm/mg KOH/g). As a further example, the ratio between a content (ppm) of metal derived from said metal detergent and based on the total weight of the lubricating oil composition and a total base number of the lubricating composition (mg KOH/g) may range from about 225 to about 425 (ppm/mg KOH/g). As an even further example, the ratio between a content (ppm) of metal derived from said metal detergent and based on the total weight of the lubricating oil composition and a total base number of the lubricating composition (mg KOH/g) may range from about 225 to about 325 (ppm/mg KOH/g).

The components may be combined such that a ratio between the content (ppm) of the metal derived from said metal detergent and a content of phosphorus derived from said phosphorus-based wear preventative ranges from about 5.0 to about 20.0 (ppm/ppm). As a further example, the ratio between the content (ppm) of the metal derived from said metal detergent and a content of phosphorus derived from said phosphorus-based wear preventative may range from about 5 to about 15 (ppm/ppm). As an even further example, the ratio between the content (ppm) of the metal derived from said metal detergent and a content of phosphorus derived from said phosphorus-based wear preventative may range from about 10 to about 15 (ppm/ppm).

The components may be combined such that a ratio between the content (ppm) of phosphorus derived from said phosphorus-based wear preventative and oil soluble molybdenum compound ranges from about 0.5 to about 80.0 (ppm/ppm). As a further example, the ratio between the content (ppm) of phosphorus derived from said phosphorus-based wear preventative and oil soluble molybdenum compound may range from about 4 to about 76 (ppm/ppm). As an even further example, the ratio between the content (ppm) of phosphorus derived from said phosphorus-based wear preventative and oil soluble molybdenum compound may range from about 4 to about 40 (ppm/ppm).

The STUO additive package may have a total base number (TBN) greater than 125. As a further example, the STUO additive package may have a TBN of about 125 to about 260. As a further example, the STUO additive package may have a TBN of about 140 to about 260. As an even further example, the STUO additive package may have a TBN of about 140 to about 210.

The use of a STUO lubricating oil composition or STUO additive package as described herein may improve the braking performance of a tractor. Such a method may comprise adding to a tractor a lubricating oil composition or an additive package as described herein and operating the wet brake of the tractor.

The use of a STUO lubricating oil composition or STUO additive package as described herein may improve the anti-wear protection of a tractor engine. Such a method may comprise adding to a tractor engine a lubricating oil composition or an additive package as described herein and operating the engine of the tractor.

Additives used in formulating the lubricating compositions described herein can be blended into the base oil individually or in various sub-combinations. Further, all of the components may be blended concurrently using an additive package (i.e., additives plus a diluent, such as a hydrocarbon solvent). The use of an additive package takes advantage of the mutual compatibility afforded by the combination of ingredients when in the form of an additive package. Also, the use of an additive package reduces blending time and lessens the possibility of blending errors.

EXAMPLES

This invention is described in more detail by inventive and comparative examples. The invention should not be limited by these examples; rather they will serve to demonstrate the utility of the invention. Tests used to differentiate the inventive STUO compositions from engine oil lubricants are water tolerance and wet brake chatter tests which are describe below.

Water Tolerance

Sensitivity of lubricating oils to water contamination is measured by mixing a lubricating oil with water in a blender, storing the mixture for seven days in a 100 mL centrifuge tube, and then centrifuging the sample to determine separation in the oil. Loss of additive can also be determined by chemical analysis of the oil phase for loss of metallic constituents of the additive.

Procedure: Add 199.2 mL of oil and 0.8 mL of distilled water to a blender container. Mix in blender at 13000±1000 rpm for 60±5 seconds. Immediately transfer 100 mL of the mixture to a clean, dry, conical type centrifuge tube. Stopper the tube with a clean, dry cork. Place test sample upright in a light-free chamber for seven days. Remove the sample from chamber and centrifuge for 60±1 min at a relative centrifugal force of 950±50 rcf. Use the following equation to calculate the centrifugal speed (in rpm) needed to obtain 950±50 rcf at the tip of the tube: RPM=13335.6 rcf/d [d=diameter of swing in mm]. Report the % vol of solids, free water, and emulsion in the test sample and percent additives separation after centrifugation. The oil phase can also be analyzed for loss of metallic constituents of the additive.

Wet Brake Chatter

The effect of tractor lubricants on brake noise and brake capacity is measured by a modified JDQ 96 wet brake procedure available from Southwest Research Institute (SwRI). For this evaluation, the lubricant is charged to a test ring, and 1000 brake cycles engagements with the standard friction materials used in the JDQ96 wet brake procedure are preformed. The brake chatter is measured at different temperatures, brake pressures, and wheel speeds. The lubricant is then drained. The test stand is flushed and then re-charged with the next lubricant. Brake Chatter is assessed after 50 brake cycles. The chatter, measured in torque variation, is compared to the John Deere acceptable chatter reference oil. Several candidates can be assessed with the same test parts. Testing lubricants with known performance can be done to confirm that the chatter results are repeatable.

Procedure: A modified, full sized JD agricultural tractor powers a JD industrial axle in the laboratory. One axle is mechanically restrained from rotation, and brake components under test are placed in the opposite axle housing. The sun pinion shaft is equipped with strain gages in order to measure dynamic torque changes as the brakes are applied over a wide range of axle speeds and loads.

The lubricant is evaluated at oil temperatures of 32, 49, 60 and 71° C. Brake chatter is measured at different brake pressures and wheel speeds using a piston plate P-19 and backing plate B-17. Relative brake capacity and torque variation is summed from all of the measurements at each temperature to get an overall relative capacity and torque variation. These results are compared to a known fluid established by John Deere as a lubricant with an acceptable level of chatter. Passing chatter criteria is given in % relative to the reference oil in torque variation as describe in the JDQ 96 procedure. A result of 100% would be equal to the result of the reference oil. A result of less than 100% is better than the reference oil in that there is less noise and less chatter. A result of greater than 100% would be worse than the reference oil, indicating more noise and more chatter.

The Mini-Traction Machine (MTM)

Friction between a steel disk and a friction material is measured using the mini-traction machine (MTM). In the MTM, a small piece of friction material is attached to the ball arm using a proprietary sample holder. A load of 5N is applied between the piece of friction material and the steel disk. Friction is measured while the steel disk is rotated at speeds between 1 mm/s and 2000 mm/s and while the oil sample is held at a temperature of 100° C. The MTM and the sample holder are described more fully in US publication no. 2006-0272401 A1.

4-Ball Wear ASTM D-4172

This test method covers a procedure for making a preliminary evaluation of the anti-wear properties of fluid lubricants in sliding contact by means of the Four-Ball Wear Test Machine and is described in ASTM D-4172.

Procedure: Three 12.7-mm diameter steel balls are clamped together and covered with the lubricant to be evaluated. A fourth 12.7-mm diameter steel ball, referred to as the top ball, is pressed with a force of 392 N into the cavity formed by the three clamped balls for three-point contact. The temperature of the test lubricant is regulated at 75° C. [167° F.] and the top ball is rotated at 1200 rpm for 60 min. Lubricants are compared by using the average size of the scar diameters worn on the three lower clamped balls.

Inventive and Comparative Examples

Inventive STUO 1

3.0 wt. % of an overbased metal sulfonate and 0.35 wt. % of an overbased metal phenate are combined with 0.1 wt. % of an organic molybdenum compound, 0.35 wt. % of a phosphorous antiwear compound, and 1.2 wt. % of a core package containing an ashless dispersant, a rust inhibitor, an antifoam agent, an antioxidant, and a diluent oil for a total additive treat rate of 5.0 wt. %. The additive package has a TBN of 211 mg KOH/g. This mixture is added to a base oil blend that contains base oils, pour point depressants, and viscosity index improvers capable of meeting the viscometric requirements of a STUO lubricant. The formulated oil contains 3885 ppm of metal-containing detergent, 295 ppm of phosphorus, and 70 ppm of Mo. The TBN of the formulated oil is 10.55 mg KOH/g. (See Table 1). This formulation provides CD engine oil performance and GL-4 gear wear and extreme pressure (EP) protection.

This lubricant was evaluated in the water tolerance test showing no emulsion, or precipitate after 7 days. The brake chatter test recorded lower torque variation than the approved reference oil, with a torque variation of 91% of the reference oil value obtained. (See Table 2).

Inventive STUO 2

3 wt. % of an overbased metal sulfonate and 0.35 wt. % of an overbased metal phenate are combined with 0.1 wt % of a organic molybdenum compound, 0.35 wt. % of phosphorous antiwear compound, 0.1 wt. % friction modifiers, and 1.2 wt. % of a core package containing ashless dispersant, rust inhibitor, antifoam antioxidant, and a diluent oil for a total additive treat rate of 5.1 wt. %. This additive package has a TBN of 212 mg KOH/g. This mixture is added to a base oil blend that contains base oils, pour point depressant, and viscosity index improvers capable of meeting the viscometric requirements of a STUO lubricant. The formulated oil contains 3885 ppm of metal containing detergent, 295 ppm of P, and 70 ppm of Mo. The TBN of the formulated oil is 10.7 mg KOH/g. (See Table 1). This formulation provides CD engine oil performance and GL-4 gear wear and EP protection.

This lubricant was evaluated in the water tolerance test showing no emulsion or precipitate after 7 days. The brake chatter test recorded lower torque variation than the approved reference oil, with a torque variation of 59% of the reference oil value obtained (See Table 2).

Comparative CD Engine Oil 1.2 wt % of an overbased metal sulfonate is combined with 0.9 wt. % of a phosphorous antiwear compound and 2.3 wt % of a core package containing ashless dispersant, rust inhibitor, antifoam antioxidant, and a diluent oil for a total additive treat rate of 4.4 wt. %. This additive package has a TBN of 123 mg KOH/g. This mixture is added to a base oil blend that contains base oils, pour point depressant, and viscosity index improvers capable of meeting the viscometric requirements of a STUO lubricant. The formulated oil contains 1109 ppm of metal containing detergent, 783 ppm of P, and 0 ppm Mo. The TBN of the formulated oil is 5.4 mg KOH/g. (See Table 1). This formulation provides CD engine oil performance.

This lubricant was evaluated in the water tolerance test and showed 15 mL of emulsion after 7 days. The brake chatter test recorded higher torque variation compared to the approved reference oil, with a torque variation of 237% of the reference oil value obtained (See Table 2).

Comparative STUO 2.3 wt. % of an overbased metal sulfonate is combined with 1.5 wt. % of a low based metal sulfonate, 1.5 wt. % of a low based metal phenate, 1.5 wt. % of a phosphorous antiwear compound, 0.7 wt % of a friction modifier package, and 5.5 wt % of a core package containing ashless dispersant, rust inhibitor, antifoam agent, antioxidant, and a diluent oil for a total additive treat rate of 13.0 wt. %. This additive package has a TBN of 90 mg KOH/g. This mixture is added to a base oil blend that contains base oils, pour point depressant, and viscosity index improvers capable of meeting the viscometric requirements of a STUO lubricant. The formulated oil contains 3536 ppm of metal containing detergent, 1521 ppm of P, and 0 ppm of Mo. The TBN of the formulated oil is 11.7 mg KOH/g. (See Table 1). This formulation provides CD engine oil performance and GL-4 gear wear and EP protection.

This lubricant was evaluated in the water tolerance test and showed no emulsion or precipitate after 7 days. The brake chatter test recorded lower torque variation compared to the approved reference oil, with a torque variation of 50% of the reference oil value obtained. (See Table 2).

TABLE 1

| | Inventive STUO 1 | Inventive STUO 2 | Comparative CD EO | Comparative STUO |
|---|---|---|---|---|
| Formulations | In Oil | In Oil | In Oil | In Oil |
| Overbased Metal Sulfonate | 3.0 | 3.0 | 1.2 | 2.3 |
| Overbased Metal Phenate | 0.35 | 0.35 | | |
| Low base Metal Sulfonate | | | | 1.5 |
| Low base Metal Phenate | | | | 1.5 |
| ZDDP | 0.35 | 0.35 | 0.9 | 1.5 |
| Mo Compound | 0.1 | 0.1 | | 0.0 |
| Friction Modifier System | | 0.1 | | 0.7 |
| Core Package | 1.2 | 1.2 | 2.3 | 5.5 |
| Treat Rate | 5.0 | 5.1 | 4.4 | 13.0 |
| Additive Package TBN, mg KOH/g | 211.0 | 212.0 | 123.0 | 90.0 |
| Base Oil Blend | balance | balance | balance | balance |

NOTE:
Core Package may contain a combination of one or more of a dispersant, an antioxidant, an antifoamant, a rust inhibitor, and a diluent oil.

TABLE 2

| | Inventive STUO 1 | Inventive STUO 2 | Comparative CD EO | Comparative STUO |
|---|---|---|---|---|
| Performance Level | CD/GL-4 | CD/GL-4 | CD | CD/GL-4 |
| Ca ppm (M+) | 3885 | 3885 | 1108.8 | 3536 |
| P ppm | 295 | 295 | 783.2 | 1521 |

TABLE 2-continued

| | Inventive STUO 1 | Inventive STUO 2 | Comparative CD EO | Comparative STUO |
|---|---|---|---|---|
| Mo ppm | 70 | 70 | 0 | 0 |
| Fully formulated oil TBN, mg KOH/g | 10.55 | 10.7 | 5.41 | 11.7 |
| M+/P | 13.17 ppm/ppm | 13.17 ppm/ppm | 1.42 ppm/ppm | 2.32 ppm/ppm |
| P/Mo | 4.21 ppm/ppm | 4.21 ppm/ppm | No Mo | No Mo |
| M+/TBN | 368.2 ppm/mgKOH/g | 363.1 ppm/mgKOH/g | 204.9 ppm/mgKOH/g | 302.2 ppm/mgKOH/g |
| STUO Tests | | | | |
| Wet Brake (<Ref Oil) | 91% | 59% | 237% | 50% |
| Water Tolerance | | | | |
| mL separation | 0 mL | 0 mL | 15 mL | 0 mL |
| mL precipitate | 0 mL | 0 mL | 0 mL | 0 mL |

Samples were prepared to demonstrate that formulations meeting the breadth of the claims all demonstrate performance similar to the inventive examples. The nine run design (see Table 3) uses the following 4 variables:

| Variable | Range |
|---|---|
| TBN of the additive package | 140–260 |
| Metal/TBN of the fully formulated oil (ppm/ppm) | 225–425 |
| Metal/Phosphorous (ppm/ppm) | 5–15 |
| Phosphorous/Molybdenum (ppm/ppm) | 4–76 |

TABLE 3

| | Additive Package TBN | M+/TBN | M+/P | P/Mo |
|---|---|---|---|---|
| Matrix 1 | 140 | 225 | 5 | 4 |
| Matrix 2 | 140 | 325 | 10 | 40 |
| Matrix 3 | 140 | 425 | 15 | 76 |
| Matrix 4 | 210 | 225 | 10 | 76 |
| Matrix 5 | 210 | 325 | 15 | 4 |
| Matrix 6 | 210 | 425 | 5 | 40 |
| Matrix 7 | 260 | 225 | 15 | 40 |
| Matrix 8 | 260 | 325 | 5 | 76 |
| Matrix 9 | 260 | 425 | 10 | 4 |

Explanation of Test Results on Inventive and Comparative Examples

We have discovered that engine oils meeting the CD performance levels must be combined in a particular way in to make them suitable for use as tractor oil, because of the necessity for tolerating water contamination and providing low noise during braking. It is apparent from the inventive examples that the ratio of the ppm of the metal from the detergent and the TBN of the fully formulated oil can be combined in a particular ratio to meet the required water tolerance and wet brake chatter necessary for a STUO lubricant. Inventive STUO 2 demonstrates that the addition of friction modifiers can lower the wet brake chatter while still maintaining water tolerance.

The frictional performance of the Inventive and Comparative examples can also be demonstrated by (1) the ratio of friction at 600 mm/s divided by friction at 16 mm/s in a Mini-Traction Machine and (2) the dynamic friction at 16 mm/s (See Table 4 below). The Friction coefficient of a tractor fluid should increase with respect to speed to avoid brake noise, and be high enough to provide sufficient torque capacity. If the torque capacity is too high, then brake chatter can also increase and may result in high wear. This is demonstrated by the μ600/μ6 mm/s ratio of <1.0 with the Comparative CD Engine oil versus the μ600/μ6 mm/s ratio of >1.0 with Inventive and Matrix examples. The 0.42 dynamic coefficient of friction at 16 m/s in the Comparative CD Engine oil indicates a high torque capacity that is much higher than the John Deere Reference Tractor Oil (a typical tractor oil formulation). The John Deere Reference Tractor Oil (or John Deere Wet Brake Screener Test Oil) is used as a reference oil to determine passing and failing oils. In the dynamic coefficient of friction at 16 mm/s results, a passing oil is one having a value less than the John Deere Reference Tractor Oil. By comparison, the John Deere Reference Tractor Oil and the Comparative STUO formulations had between 0.28 and 0.12 dynamic coefficient of friction at 16 mm/s, which indicates an acceptable range of torque capacity and wear of tractor additives. The Inventive STUO and matrix samples have coefficients of friction at 16 mm/s between the John Deere Reference Tractor Oil and the Comparative STUO.

Tables 3 and 4 also show that good wear performance (as demonstrated by the 4-Ball Wear test) is achieved with inventive STUO and the 9 matrix samples, which have phosphorus levels between about 844 ppm to about 146 ppm. The inventive STUO and matrix samples give less than 0.44 mm wear scar, which is sufficient to provide antiwear performance for tractor applications.

It is also apparent from the inventive examples and the comparative examples that the specified ratio ranges of the ppm of the metal from the detergent to the ppm of the phosphorous compound, along with the specified ratio ranges of the ppm of the phosphorous compound to the ppm of the molybdenum compound allow a high level of detergent to be incorporated into the STUO formulation while still maintaining antiwear performance and minimizing the overall P level of the formulated oil. The inventive STUO 1 and STUO 2 provide higher package TBN that can deliver high TBN to the formulated oil at a much lower treat rate than the conventional STUO or Comparative CD Engine Oil.

TABLE 4

| | | | Phosphorus | | Water Tolerance | |
|---|---|---|---|---|---|---|
| | CoF/Ratio μ600/μ16 | CoF μ16 | Level ppm | 4-Ball mm Wear | mL separation | mL precipitate |
| Comparative CD Engine Oil | 0.94 | 0.42 | 783 | 0.462 | 15 mL | 0 mL |
| John Deere Reference Tractor Oil | 1.21 | 0.28 | 1098 | 0.333 | 0 mL | 0 mL |
| Inventive STUO 1 | 1.28 | 0.20 | 295 | 0.389 | 0 mL | 0 mL |
| Comparative STUO | 1.75 | 0.12 | 1521 | 0.31 | 0 mL | 0 mL |
| Matrix 1 | 1.26 | 0.21 | 439 | 0.389 | 0 mL | 0 mL |
| Matrix 2 | 1.13 | 0.24 | 637 | 0436 | 0 mL | 0 mL |
| Matrix 3 | 1.24 | 0.20 | 278 | 0.372 | 0 mL | 0 mL |
| Matrix 4 | 1.12 | 0.22 | 217 | 0.359 | 0 mL | 0 mL |
| Matrix 5 | 1.11 | 0.24 | 208 | 0.398 | 0 mL | 0 mL |
| Matrix 6 | 1.39 | 0.20 | 844 | 0.372 | 0 mL | 0 mL |
| Matrix 7 | 1.15 | 0.22 | 146 | 0.333 | 0 mL | 0 mL |
| Matrix 8 | 1.199 | 0.21 | 311 | 0.385 | 0 mL | 0 mL |
| Matrix 9 | 1.26 | 0.22 | 415 | 0.398 | 0 mL | 0 mL |

Other embodiments of the present disclosure will be apparent to those skilled in the art from consideration of the specification and practice of the invention disclosed herein. As used throughout the specification and claims, "a" and/or "an" may refer to one or more than one. Unless otherwise indicated, all numbers expressing quantities of ingredients, properties such as molecular weight, percent, weight percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application by the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

What is claimed is:

1. A super tractor oil universal lubricating composition comprising:

a) an oil of lubricating viscosity having a viscosity index of at least about 95, formulated with additive components comprising:

i) at least one metal detergent;

ii) at least one phosphorus-based wear preventative, comprising phosphorus in an amount of about 200 ppm to about 400 ppm based on the total weight of the lubricating composition;

iii) at least one oil soluble molybdenum compound, wherein an amount of molybdenum from the molybdenum compound ranges from about 10 ppm to no more than 200 ppm based on the total weight of the lubricating composition;

b) characterized in that a ratio between a content (ppm) of metal based on the total weight of the lubricating composition and a total base number of the lubricating composition (mg KOH/g) ranges from about 210 to about 450 (ppm/mg KOH/g);

c) a ratio between the content (ppm) of the metal based on the total weight of the lubricating composition and a content (ppm) of phosphorus based on the total weight of the lubricating composition ranges from about 5.0 to about 20.0 (ppm/ppm); and d) a ratio between the content (ppm) of phosphorus based on the total weight of the lubricating composition and a content (ppm) of molybdenum based on the total weight of the lubricating composition ranges from about 0.5 to about 80.0 (ppm/ppm), wherein the lubricating composition is further characterized as having no water separation and no precipitate in a water tolerance test wherein the water separation and precipitate are measured by mixing 199.2 mL of the lubricating composition with 0.8 mL water in a blender, storing 100 mL of the resulting sample in a centrifuge tube for seven days, and centrifuging the sample to determine separation in the oil.

2. The composition according to claim 1, wherein said metal detergent is selected from the group consisting of calcium phenates, calcium salicylates, calcium sulfonates, and mixtures thereof.

3. The composition according to claim 1, comprising at least two metal detergents.

4. The composition according to claim 1, wherein said at least one metal detergent is an overbased calcium sulfonate.

5. The composition according to claim 4, wherein said overbased calcium sulfonate has a total base number of between about 150 to about 450.

6. The composition according to claim 1, wherein said molybdenum compound is an organo-molybdenum compound.

7. The composition according to claim 6, wherein said molybdenum compound is selected from the group consisting of: a molybdenum dialkyldithiocarbamate, molybdenum dialkyldithiophosphate, molybdenum dialkyldithiophosphinate, molybdenum xanthate, molybdenum thioxanthate, and mixtures thereof.

8. The composition according to claim 7, wherein said molybdenum compound is present as molybdenum dialkyldithiocarbamate.

9. The composition according to claim 1, wherein the at least one phosphorus-based wear preventative comprises at least one metal dihydrocarbyl dithiophosphate compound.

10. The composition according to claim 8, wherein said at least one metal dihydrocarbyl dithiophosphate compound comprises at least one zinc dihydrocarbyl dithiophosphate compound.

11. The composition according to claim 9, wherein said composition contains from about 200 to 400 ppm phosphorus from the metal dihydrocarbyl dithiophosphate compound.

12. The composition according to claim 1, further comprising at least one organic ashless friction modifier.

13. The composition according to claim 12, wherein said at least one organic ashless friction modifier is oleyl amide.

14. The composition according to claim 1, wherein the composition comprises from about 146 ppm to about 844 ppm of phosphorus.

15. A method for improving the braking performance of a tractor, which comprises: (1) adding to the tractor the lubricating oil composition of claim 1; and (2) operating the wet brake of the tractor.

16. A method for improving the anti-wear protection of a tractor engine comprising the steps of: (1) adding to the tractor engine a lubricating oil composition of claim 1; and (2) operating the tractor engine.

17. A super tractor oil universal additive package comprising:

a) a metal detergent; b) a phosphorus-based wear preventative, comprising phosphorus in an amount of about 200 ppm to about 400 ppm based on the total weight of the lubricating composition;

c) an oil soluble molybdenum compound, wherein the molybdenum compound is present in the additive package in an amount that provides from about 10 ppm to no more than 200 ppm molybdenum to a lubricant composition containing the additive package based on the total weight of the lubricant composition;

d) characterized in that a ratio between a content (ppm) of metal based on the total weight of the additive package and a total base number of the additive package (mg KOH/g) ranges from about 210 to about 450 (ppm/mg KOH/g);

e) a ratio between the content (ppm) of the metal based on the total weight of the additive package and a content (ppm) of phosphorus based on the total weight of the additive package ranges from about 5.0 to about 20.0 (ppm/ppm); and f) a ratio between the content (ppm) of phosphorus based on the total weight of the additive package and a content (ppm) of molybdenum based on the total weight of the additive package ranges from about 0.5 to about 80.0 (ppm/ppm), wherein the lubricating composition is further characterized as having no water separation and no precipitate in a water tolerance test wherein the water separation and precipitate are measured by mixing 199.2 mL of the lubricating composition with 0.8 mL water in a blender, storing 100 mL of the resulting sample in a centrifuge tube for seven days, and centrifuging the sample to determine separation in the oil.

18. The composition according to claim 17, wherein the total base number (TBN) of the additive package is greater than about 125.

* * * * *